United States Patent [19]

Kuo

[11] Patent Number: 4,938,626

[45] Date of Patent: Jul. 3, 1990

[54] LEAD-REPLACEABLE WRITING IMPLEMENT WITH MULTIPLE LEAD CHANNELS

[76] Inventor: Chun-Liang Kuo, 1st Fl., Alley 23, Lane 2, Sec. 6, Chungshan N. Rd., Taipei, Taiwan

[21] Appl. No.: 375,742

[22] Filed: Jul. 5, 1989

[51] Int. Cl.[5] ..... B43K 21/14; B43K 21/20

[52] U.S. Cl. ..... 401/56; 401/65; 401/90; 401/57

[58] Field of Search ..... 401/56, 57, 58, 65, 401/83, 85, 87, 90, 80, 32, 104

[56] References Cited

U.S. PATENT DOCUMENTS

| | | | |
|---|---|---|---|
| 1,572,133 | 2/1926 | Fleming | 401/56 |
| 1,655,417 | 1/1928 | Haack | 401/56 |
| 2,176,050 | 10/1939 | Bailey | 401/56 |
| 2,512,273 | 6/1950 | Harvey | 401/90 |
| 2,691,364 | 10/1954 | Valsecchi et al. | 401/56 |
| 3,918,819 | 11/1975 | Liu | 401/57 |
| 4,219,282 | 8/1980 | Kuo | 401/65 |
| 4,359,290 | 11/1982 | Sekiguchi et al. | 401/56 |

FOREIGN PATENT DOCUMENTS

| | | | |
|---|---|---|---|
| 1236973 | 3/1967 | Fed. Rep. of Germany | 401/57 |
| 9047 | of 1893 | United Kingdom | 401/90 |

*Primary Examiner*—Danton D. DeMille

*Attorney, Agent, or Firm*—Asian Pacific Int'l Patent and Trademark Office

[57] ABSTRACT

A lead-replaceable writing implement including an outer tube, an inner rod received in the outer tube and formed with multiple lead channels and a push rod, a rotary tube partially inserted into a lower end of the outer tube, and a lead holder received in the rotary tube and partially protruded beyond the lower end thereof, wherein the multiple lead channels respectively contain several series of leads of different hardness, and the rotary tube is formed with a lead stop whereby when rotating the rotary tube to locate the lead stop right above a lead channel and then push the inner rod upward, the lead stop will stop a lowest lead with desired hardness from rising and drop the stopped lead into the lead holder, and when thereafter pressing the inner rod downward, the push rod thereof will partially protrude the dropped lead beyond the lead holder for writing.

8 Claims, 3 Drawing Sheets

LEAD-REPLACEABLE WRITING IMPLEMENT WITH MULTIPLE LEAD CHANNELS

BACKGROUND OF THE INVENTION

The present invention relates to a lead-replaceable writing implement, and more particularly to a writing implement having multiple lead channels containing several series of leads with different hardness.

The presently used pencils can be divided into three types, namely, whittle pencil, sharpening-free pencil, and mechanical pencil. The earliest whittle pencils must be sharpened with a pen-knife or a pencil sharpener. This sharpening manner is very inconvenient and unsafe while the sharpening-free pencils need to be fed with multiple presharpened lead and a dull lead must be replaced with a new one by hand which always makes the hand contaminated by the lead. Therefore, the mechanical pencils are developed to substitute the above two types of pencils. The mechanical pencils use a fine lead with about 0.5 mm diameter, which can be pressed to protrude for writing. However, the mechanical pencils can only be fed with one lead of a certain hardness, and, therefore, it is not available when various leads of different hardness are required.

Thus, a writing implement provided with multiple lead channels respectively containing several leads of different hardnesses is developed by the applicant to eliminate the above-mentioned drawbacks.

SUMMARY OF THE INVENTION

It is therefore an object of the present invention to provide a lead-replaceable writing implement having a rotary tube and an inner rod formed with multiple lead channels to respectively contain several series of leads of different hardness whereby a lead of desired hardness can be settled via rotating the rotary tube.

It is a further object of the present invention to provide the above writing implement wherein the lead replacing operation can be easily done and the hardness of used lead is indicated by indexes provides on the rotary tube.

The present invention can be best understood by the following description and accompanying drawings wherein:

DETAILED DESCRIPTION OF THE PREFERRED EMBODIMENTS

Figure 1:
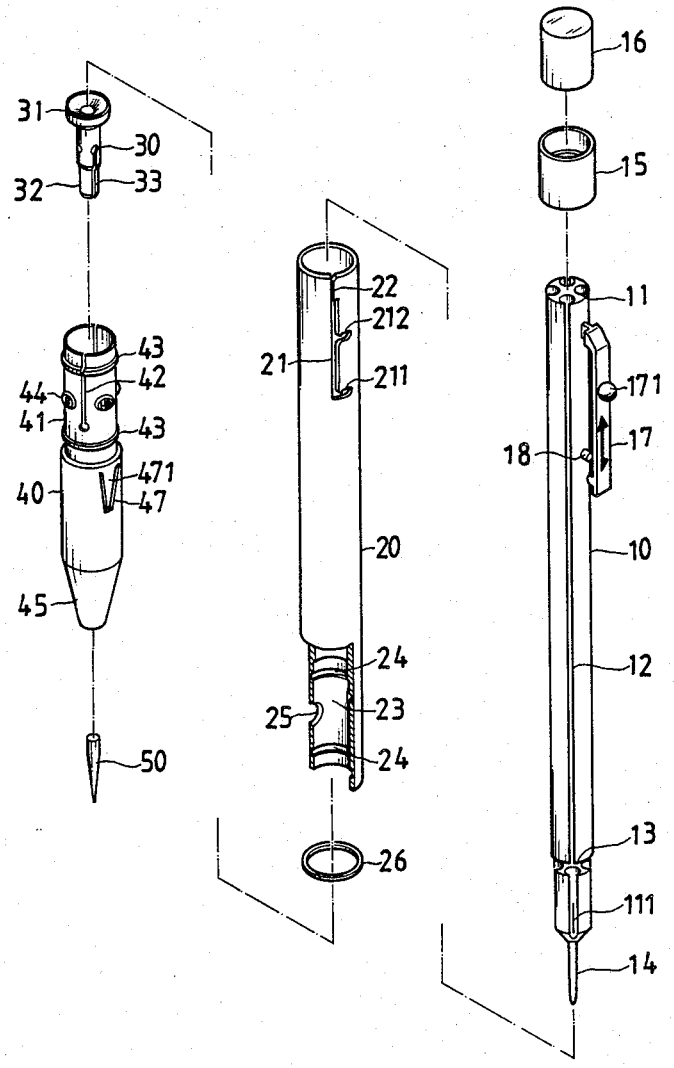
FIG. 1 is a perspective fragmentary view of the present invention.
Figure 2:
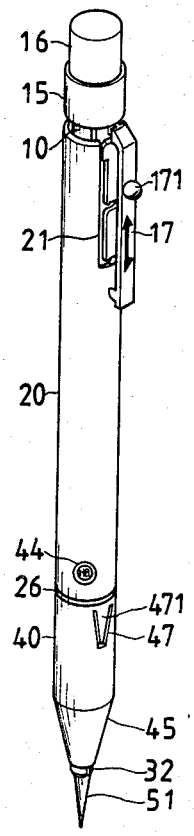
FIG. 2 is an assembled view of the present invention.
Figure 8:
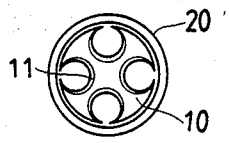
FIG. 8 is a sectional view taken on line 8—8 of FIG. 7.
Figure 9:
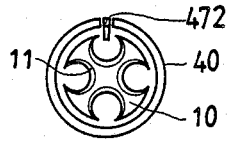
FIG. 9 is a sectional view taken on line 9—9 of FIG. 7, showing the lead stop located in the lead channel.
Figures 3, 4, 5, 6:
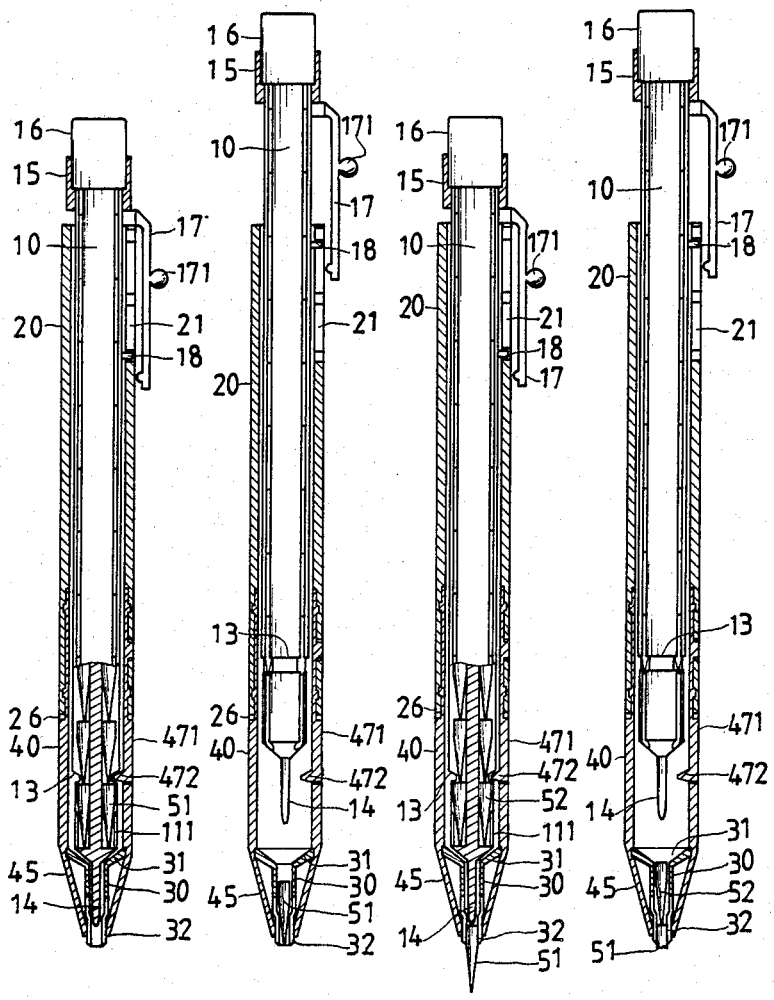
FIG. 3 is a longitudinal sectional view of the present invention, illustrating a status that the leads are held inside the lead channels.
FIG. 4 is a sectional view according to FIG. 3, illustrating a status that the inner rod is pushed upward to drop a lead into the lead holder.
FIG. 5 shows a status that the inner rod is pressed downward to partially protrude a lead outside the lead holder.
FIG. 6 shows a status that the protruded lead is broken, and a new lead is to be protruded to replace the broken one.

Referring to FIGS. 1, 2, and 3, the present invention includes an inner rod 10, an outer tube 20, a lead holder 30 and a rotary tube 40. The inner rod 10 is formed with plural axially extending circular lead channels 11, shown four as in FIG. 1, each containing a series of pre-sharpened leads 50 of various hardness such as HB, B, B2, etc., but it is understood that a greater number may be used without departing from the spirit of the invention. A push rod 14 is mounted on the bottom of the inner rod 10, and an annular groove 13 is formed on the inner rod 10 above the push rod 14. Each lead channel 11 is provided with a axially extending slide opening portion 12 defining a axial passage between the exterior of the inner rod 10 and the interior of each lead channel 11. The diameter of the portion below the annular groove 13 of the inner rod 10 is smaller than that of the portion above the annular groove 13. Therefore, a wider slide opening portion 12 of the lead channel 11 is formed below the annular groove 13 as shown in FIGS. 8 and 9.

The inner surface of the rotary tube 40 is formed with a lead stop 472 suitable for extending into the slide opening portion 12 to stop the lead 50 contained in the lead channel 11. A protuberance 111 is formed on the bottom of each lead channel 11 to prevent the lead from dropping naturally. A socket 15 with an eraser 16 inserted therein is coupled to the top of the inner rod 10 to prevent the leads 50 from slipping off from the top opening of the lead channel 11. A clip 17 having a globe 171 is fitted to the upper end of the inner rod 10 for pressing down and pushing up the inner rod 10. A locating boss 18 is further formed on the upper end of the inner rod 10 for locating the same in the outer tube 20.

A slide slot 21 is formed on the outer tube 20, permitting the locating boss 18 to slide therein. A narrowed slot 22 is formed above the slide slot 21 whereby when inserting the inner rod 10 into the outer tube 20, the boss 18 must be forced to slide through the narrowed slot 22 to enter the slide slot 21, and reversely, the inner rod 10 can not separate from the outer tube 20 without forcing the boss 18 to go through the narrowed slot 22. The rotary tube 40 has a top portion 41 inserted into a bottom portion 23 of the outer tube 20. Furthermore, a O-ring 26 is clipped between the top portion 41 and the bottom portion 23. Two longitudinal grooves 42 are formed on the top portion 41 to make the wall thereof resilient for engaging with the bottom portion 23 of the outer tube 20. Two outer flanges 43 are provided on the top portion 41 to engage with two annular canal 24 formed on the inner surface of the bottom 23, permitting the rotary tube 40 to rotarily connect with the outer tube 20. A plurality of projections 44 each having a hardness index are disposed on the top portion 41. While a window 25 is formed on the bottom portion 23 for receiving the projections 44 to show the hardness indexes.

The lead holder 30 is placed inside the rotary tube 40, having a top flange 31 suitable for abutting against the inner surface of the tapered lower portion 45 of the rotary tube 40, permitting the lead holder 30 to slightly protrude beyond the rotary tube 40. The lead holder 30 has a lower narrowed portion 32 formed with two slits 33 to make the lower portion 32 resilient.

When the lead 50 drops into the lead holder 30, the lead 50 is stopped by the lower portion 32. But a pressing force can push the lead to partially protrude beyond the expanded lower end 32.

A V-shaped slit 47 is formed on the rotary tube 40 to define a resilient stop means 471 having a lead stop 472 suitable for extending into the lead channels 11 to stop the lead 50 contained therein as shown in shown in FIG. 9.

Figure 10:
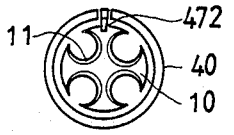
FIG. 10 is a sectional view according to FIG. 9, showing the lead stop located in the annular groove when changing the lead channel.

Referring to FIG. 3, when a plurality of leads 50 are fed into the lead channels 11, the lead stop 472 is located between two lead channels 11 as shown in FIG. 10, letting the leads 50 freely drop to the bottom of the lead channels 11. However, the leads 50 will be stopped and retained by the protuberances 111 of the lead channels 11.

Referring to FIG. 4, in order to protrude the lowest lead 51 for writing, the rotary tube 40 is rotated to align the projection 44 with the window 25 and the lead stop 472 is located above the desired lead channel 11 as shown in FIG. 9. Then, the inner rod 10 is pushed upward until the boss 18 reaches the top of the slide slot 21, permitting the lead stop 472 to stop and drop the lowest lead 50 into the lower end 32 of the lead holder 30.

Referring to FIG. 5, thereafter, the push rod 14 together with the inner rod 10 is pressed down to urge the dropped lead 51 to protrude beyond the lead holder 30 for writing. A writing transverse recess 211 formed on the bottom end of the slide slot 21 can receive the boss 18 when rotating the inner rod 10 to locate the lead stop 472 between two lead channels 11, as shown in FIG. 10. The end of the recess 211 adjacent to the slide slot 21 has a smaller width so that the boss 18 must be pushed by force to enter or retreat from the recess 211, thereby preventing the inner rod 10 from undesiredly moving.

Referring to FIG. 6, when the protruded lead 50 is broken or gets dull and a new lead 50 is to be protruded, the inner rod 10 rotated to retreat the boss 18 from the recess 211. The inner rod 10 is then pressed upward to make the new lead 52 dropped into the lead holder 13 and then pressed downward to push the new dropped lead 52 and urge the broken 51 to drop down.

To change the lead hardness, the rotary tube 40 rotated to select a desired lead channel 11 and locate the lead stop 472 right thereabove as shown in FIG. 9. Thereafter, the aforesaid procedure is implemented to protrude the desired lead for writing.

Figure 7:
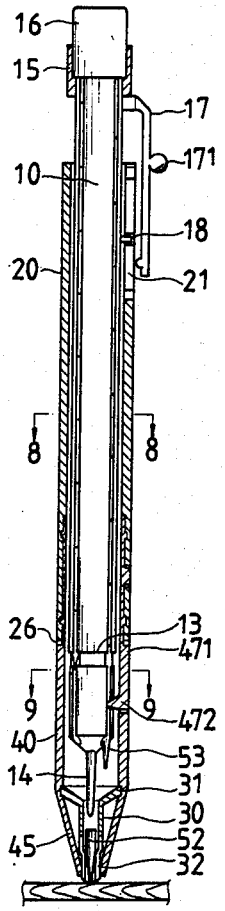
FIG. 7 shows a status that the protruded lead is pressed against a table surface and retreated into the lead holder.

Referring to FIG. 7, to retreat the used lead 52 after writing, the lead 52 is pressed against a table surface 60 to thereby push the inner rod 10 upward to let the lowest lead 53 in the lead channel 11 will not be protruded therebeyond by the lead stop 472, and the retreated lead 52 is held by the narrowed end of the lead holder 30. Furthermore, a retreating transverse recess 212 formed on the middle of the slide slot 21 can receive the boss 18 when rotating the inner rod 10 to let the push rod 14 can not be opposed against the retreated lead 52. The end of the retreating transverse recess 212 adjacent to the slide slot 21 has a smaller width so that the boss 18 must be pushed by force to enter or retreat from the recess 212, thereby preventing the inner rod 10 from undesiredly moving.

As indicated, the structure herein may be variously embodied. Recognizing various modifications will be apparent, the scope hereof shall be deemed to be defined by the claims as set forth below.

What is claimed is:

1. A lead-replaceable writing implement with multiple lead channels, comprising:

an outer tube having a lower portion and an upper portion and an upper portion formed with a slide slot;

an inner rod received in said outer tube, having plural axial lead channels capable of receiving various leads of different hardnesses separately, said inner rod further having a locating boss being slidably received in said slide slot said inner rod having a lower portion formed with an annular groove, a push rod being mounted on the bottom end of said inner rod, each lead channel being provided with a axially extending slide opening portion, a protuberance being formed on the bottom inner surface of each said lead channel;

a rotary tube having a tapered lower portion and an upper portion inserted into said lower portion of said outer tube, said rotary tube being formed with a V-shaped slit defining a resilient stop means having a lead stop, said lead stop being rotarily located within said inner rod to stop and drop a lead contained therein when said inner rod is pushed upward; and a lead holder having a narrowed lower portion and a top flange, said lead holder being received in said rotary tube with said top flange abutting against the inner surface of said tapered lower portion, said lower end of said lead holder being partially protruded beyond said lower portion of said rotary tube whereby the dropped lead is retained, said narrowed lower portion being formed with two slits to make said narrowed lower portion resilient;

said boss reaching the bottom of said slide slot to make said push rod inserted into said lead holder, while reaching the top, said push rod retreated from said lead holder.

2. A writing implement as claimed in claim 1, wherein plural projections disposed on said upper portion of said rotary tube are received in a window formed on said bottom portion of said outer tube.

3. A writing implement as claimed in claim 2, wherein said plural projections are written thereon of the hardness indexes.

4. A writing implement as claimed in claim 1, wherein a writing transverse recess being formed on the bottom end of said slide slot receives said boss, the end of said writing transverse recess adjacent to said slide slot having a smaller width.

5. A writing implement as claimed in claim 1, wherein a retreating transverse recess being formed on said slide slot receives said boss so as to prevent said push rod from pushing against the used lead for retreating and to prevent the lowest lead in said lead channel from being discharged by said lead stop, the end of said retreating transverse recess adjacent to said slide slot having a smaller width.

6. A writing implement as claimed in claim 1, wherein a clip member is fitted to the top end of said inner rod.

7. A writing implement as claimed in claim 1, wherein a socket with an eraser inserted therein is coupled to the top end of said inner rod to prevent the leads from slipping off from said lead channel.

8. A writing implement as claimed in claim 1, wherein O-ring is clipped between said top portion of said rotary tube and said bottom portion of said outer tube.

* * * * *